US010039951B2

(12) United States Patent
Chang

(10) Patent No.: US 10,039,951 B2
(45) Date of Patent: Aug. 7, 2018

(54) HORSE RIDING EXERCISE MACHINE

(71) Applicant: Chung-Fu Chang, Changhua County (TW)

(72) Inventor: Chung-Fu Chang, Changhua County (TW)

( * ) Notice: Subject to any disclaimer, the term of this patent is extended or adjusted under 35 U.S.C. 154(b) by 0 days.

(21) Appl. No.: 15/475,375

(22) Filed: Mar. 31, 2017

(65) Prior Publication Data

US 2017/0291062 A1 Oct. 12, 2017

(30) Foreign Application Priority Data

Apr. 6, 2016 (CN) ..... 2016 2 0276632 U

(51) Int. Cl.

| | |
|---|---|
| ***A63B 22/06*** | (2006.01) |
| ***A63B 69/16*** | (2006.01) |
| ***A63B 22/00*** | (2006.01) |
| ***A63B 23/035*** | (2006.01) |
| ***A63B 21/00*** | (2006.01) |

(52) U.S. Cl.

CPC ..... *A63B 22/0087* (2013.01); *A63B 21/4034* (2015.10); *A63B 21/4035* (2015.10); *A63B 22/0012* (2013.01); *A63B 22/0046* (2013.01); *A63B 22/0605* (2013.01); *A63B 23/03575* (2013.01); *A63B 2210/50* (2013.01)

(58) Field of Classification Search

CPC ..... A63B 21/4034; A63B 21/4035; A63B 22/0012; A63B 22/0046; A63B 22/0087; A63B 22/0605; A63B 23/03575; A63B 2210/50; A63B 2244/24

See application file for complete search history.

(56) References Cited

U.S. PATENT DOCUMENTS 5,356,357 A * 10/1994 Wang ..... A63B 21/068 482/57
5,464,378 A * 11/1995 Yu ..... A63B 21/068 482/57
5,556,361 A * 9/1996 Liao ..... A63B 21/068 482/72
5,569,132 A * 10/1996 Wu ..... A63B 21/068 482/72
5,582,562 A * 12/1996 Wang ..... A63B 21/068 482/57
5,626,542 A * 5/1997 Dalebout ..... A63B 21/068 482/72
5,643,150 A * 7/1997 Lee ..... A63B 21/068 482/76
5,672,142 A * 9/1997 Wu ..... A63B 22/0076 482/57
7,097,598 B2 * 8/2006 Lee ..... A63B 22/0012 482/57

(Continued)

*Primary Examiner* — Joshua Lee
(74) *Attorney, Agent, or Firm* — Jackson IPG PLLC; Demian K. Jackson

(57) ABSTRACT

A horse riding exercise machine is not only compact in structure but also easy to be assembled and disassembled. When in use, a second N-shaped connecting rod and/or a return member are provided to achieve a labor-saving effect for exercise. Through a compact structure and the detachable connection of a bolt, when the horse riding exercise machine is not used, the bolt can be loosened so that a rear support base can be pushed toward a front support base to close up, thereby reducing the storage space to facilitate the storage.

9 Claims, 7 Drawing Sheets

(56) References Cited

U.S. PATENT DOCUMENTS

| | | | | |
|---|---|---|---|---|
| 7,393,308 | B1 * | 7/2008 | Huang | A63B 22/001 482/51 |
| 2006/0217238 | A1 * | 9/2006 | Liao | A63B 23/03583 482/72 |
| 2010/0130331 | A1 * | 5/2010 | Hu | A63B 22/0046 482/57 |
| 2010/0248902 | A1 * | 9/2010 | Ge | A63B 22/0089 482/51 |

* cited by examiner

HORSE RIDING EXERCISE MACHINE

FIELD OF THE INVENTION

The present invention relates to an exercise machine, and more particularly to a horse riding exercise machine.

BACKGROUND OF THE INVENTION

A conventional exercise bike includes a main frame which is generally fixed, so it only provides the function of bike riding, not having the function for the user to stretch his/her body. Taiwan Patent Application No. 95200757 discloses "an improvement of an exercise bike", and Taiwan Patent Application No. 94221425 discloses a "horse riding exercise bike". When these two exercise bikes are used, the handle and the seat can be synchronously swung back and forth along with the motion of the pedals. But, the handle and the seat are always maintained in an equidistant state. Only the user's body shakes back and forth. It cannot achieve the function of full-body exercise. In addition, the fixed exercise bike is bulky and cannot be folded, so it always occupies space. Accordingly, the inventor of the present invention has devoted himself based on his many years of practical experiences to solve these problems.

SUMMARY OF THE INVENTION

In view of the problems of the prior art, the primary object of the present invention is to provide a horse riding exercise machine which is not only compact in structure but also easy to be assembled and disassembled. When in use, a second N-shaped connecting rod and/or a return member are provided to achieve a labor-saving effect for exercise. Through a compact structure and the detachable connection of a bolt, when the horse riding exercise machine is not used, the bolt can be loosened so that a rear support base can be pushed toward a front support base to close up, thereby reducing the storage space to facilitate the storage.

According to one aspect of the present invention, a horse riding exercise machine is provided. The horse riding exercise machine comprises a front support base, two coupling plates, a rear support base, a handle support seat, a seat support seat, and a first N-shaped connecting rod. The two coupling plates are disposed at two sides of an upper end of the front support base. Each coupling plate has a plate body, a first fixing hole, a first arc groove, a second fixing hole, a second arc groove, and at least one third fixing hole. The plate body is disposed at the upper end of the front support base. The first fixing hole and the first arc groove are spaced from each other and disposed close to a front end of the plate body. The first fixing hole is above the first arc groove. The at least one third fixing hole is disposed close to a rear end of the plate body. The second fixing hole and the second arc groove are being spaced from each other and disposed at a predetermined position between the front end and the rear end of the plate body. The second fixing hole is above the second arc groove. A top end of the rear support base is detachably connected to the at least one third fixing hole of each coupling plate. A bottom end of the handle support unit is pivotally connected to a top end of each coupling plate. The handle support unit has at least one handle, a connecting rod, a first shaft hole, a first slide hole, two extension pieces, and two pivot holes. The at least one handle extends upward from a top end of the connecting rod. The two extension pieces extend downward from two sides of a bottom end of the connecting rod, respectively. The two extension pieces are disposed corresponding to the two coupling plates, respectively, The two extension pieces are formed with the two pivot holes, respectively. The two pivot holes are not coaxial. The first shaft hole and the first slide hole penetrate two sides of the connecting rod close to the two extension pieces. The first shaft hole is above the first slide hole. The first shaft hole corresponds in position to the first fixing hole of each coupling plate to be connected. The first slide hole corresponds in position to the first arc groove of each coupling plate to be connected. The connecting rod is pivoted and slidable along the first arc groove with the first fixing hole as a pivot. The seat support unit includes a seat, a telescopic rod, a second shaft hole, and a second slide hole. The seat is disposed at a top end of the telescopic rod. The second shaft hole and the second slide hole are disposed close to a bottom end of the telescopic rod. The second shaft hole is above the second slide hole. The telescopic rod is inserted between the two coupling plates. The second shaft hole corresponds in position to the second fixing hole of each coupling plate to be connected. The second slide hole corresponds in position to the second arc groove of each coupling plate to be connected. The telescopic rod is pivoted and slidable along the second arc groove with the second fixing hole as a pivot. The first N-shaped connecting rod is disposed between the two extension pieces. Two ends of the first N-shaped connecting rod are pivotally connected to the pivot holes, respectively. A right rod section of the first N-shaped connecting rod is pivotally connected to a front side of the telescopic rod through a drive rod.

Preferably, the horse riding exercise machine further comprises a return assembly. Two ends of the return assembly are pivotally connected to a rear end of each coupling plate and a rear side of the telescopic rod, respectively.

In some embodiments, the return assembly is a pneumatic cylinder or a return spring.

In some embodiments, one end of the drive rod, connected with the right rod section, is a ring. Another end of the drive rod, connected with the front side of the telescopic rod, has a U shape.

In some embodiments, the front support base has a bottom rod, an upright rod, a damping device, and two pedals. The bottom rod is placed in a horizontal manner. The upright rod extends upward obliquely from a predetermined position between two ends of the bottom rod. The damping device is disposed at a lower end of the upright rod close to the bottom rod. The two pedals are disposed at two sides of the damping device and connected to an axle of the damping device. The two pedals are disposed oppositely and extend in opposite directions of a radial direction of the damping device.

According to another aspect of the present invention, a horse riding exercise machine is provided. The horse riding exercise machine comprises a front support base, two coupling plates, a rear support base, a handle support seat, a seat support seat, a first N-shaped connecting rod, and a second N-shaped connecting rod. The front support base has a bottom rod, an upright rod, a damping device, and two pedals. The bottom rod is placed in a horizontal manner. The upright rod extends upward obliquely from a predetermined position between two ends of the bottom rod. The damping device is disposed at a lower end of the upright rod close to the bottom rod. The two pedals are disposed at two sides of the damping device and connected to an axle of the damping device. The two pedals are disposed oppositely and extend in opposite directions of a radial direction of the damping device. The two coupling plates are disposed at two sides of an upper end of the front support base. Each coupling plate has a plate body, a first fixing hole, a first arc groove, a second fixing hole, a second arc groove, and at least one third fixing hole. The plate body is disposed at the upper end of the front support base. The first fixing hole and the first arc groove are spaced from each other and disposed close to a front end of the plate body. The first fixing hole is above the first arc groove. The at least one third fixing hole is disposed close to a rear end of the plate body. The second fixing hole and the second arc groove are being spaced from each other and disposed at a predetermined position between the front end and the rear end of the plate body. The second fixing hole is above the second arc groove. A top end of the rear support base is detachably connected to the at least one third fixing hole of each coupling plate. A bottom end of the handle support unit is pivotally connected to a top end of each coupling plate. The handle support unit has at least one handle, a connecting rod, a first shaft hole, a first slide hole, two extension pieces, and two pivot holes. The at least one handle extends upward from a top end of the connecting rod. The two extension pieces extend downward from two sides of a bottom end of the connecting rod, respectively. The two extension pieces are disposed corresponding to the two coupling plates, respectively, The two extension pieces are formed with the two pivot holes, respectively. The two pivot holes are not coaxial. The first shaft hole and the first slide hole penetrate two sides of the connecting rod close to the two extension pieces. The first shaft hole is above the first slide hole. The first shaft hole corresponds in position to the first fixing hole of each coupling plate to be connected. The first slide hole corresponds in position to the first arc groove of each coupling plate to be connected. The connecting rod is pivoted and slidable along the first arc groove with the first fixing hole as a pivot. The seat support unit includes a seat, a telescopic rod, a second shaft hole, and a second slide hole. The seat is disposed at a top end of the telescopic rod. The second shaft hole and the second slide hole are disposed close to a bottom end of the telescopic rod. The second shaft hole is above the second slide hole. The telescopic rod is inserted between the two coupling plates. The second shaft hole corresponds in position to the second fixing hole of each coupling plate to be connected. The second slide hole corresponds in position to the second arc groove of each coupling plate to be connected. The telescopic rod is pivoted and slidable along the second arc groove with the second fixing hole as a pivot. The first N-shaped connecting rod is disposed between the two extension pieces. Two ends of the first N-shaped connecting rod are pivotally connected to the pivot holes, respectively. A right rod section of the first N-shaped connecting rod is pivotally connected to a front side of the telescopic rod through a drive rod. A bottom end of the second N-shaped connecting rod is pivotally connected to the pedal at the left side of the damping device. A top end of the second N-shaped connecting rod is pivotally connected to a left rod section of the first N-shaped connecting rod.

Preferably, the horse riding exercise machine further comprises a return assembly. Two ends of the return assembly are pivotally connected to a rear end of each coupling plate and a rear side of the telescopic rod, respectively.

In some embodiments, the return assembly is a pneumatic cylinder or a return spring.

In some embodiments, one end of the drive rod, connected with the right rod section, is a ring. Another end of the drive rod, connected with the front side of the telescopic rod, has a U shape.

The beneficial effects of the present invention is that the horse riding exercise machine is not only compact in structure but also easy to be assembled and disassembled. When in use, the second N-shaped connecting rod and/or the return member are configured to achieve a labor-saving effect for exercise. Through a compact structure and the detachable connection of a bolt, when the horse riding exercise machine is not used, the bolt can be loosened so that the rear support base can be pushed toward the front support base to close up, thereby reducing the storage space to facilitate the storage.

DETAILED DESCRIPTION OF THE PREFERRED EMBODIMENTS

Embodiments of the present invention will now be described, by way of example only, with reference to the accompanying drawings.

Figure 6:
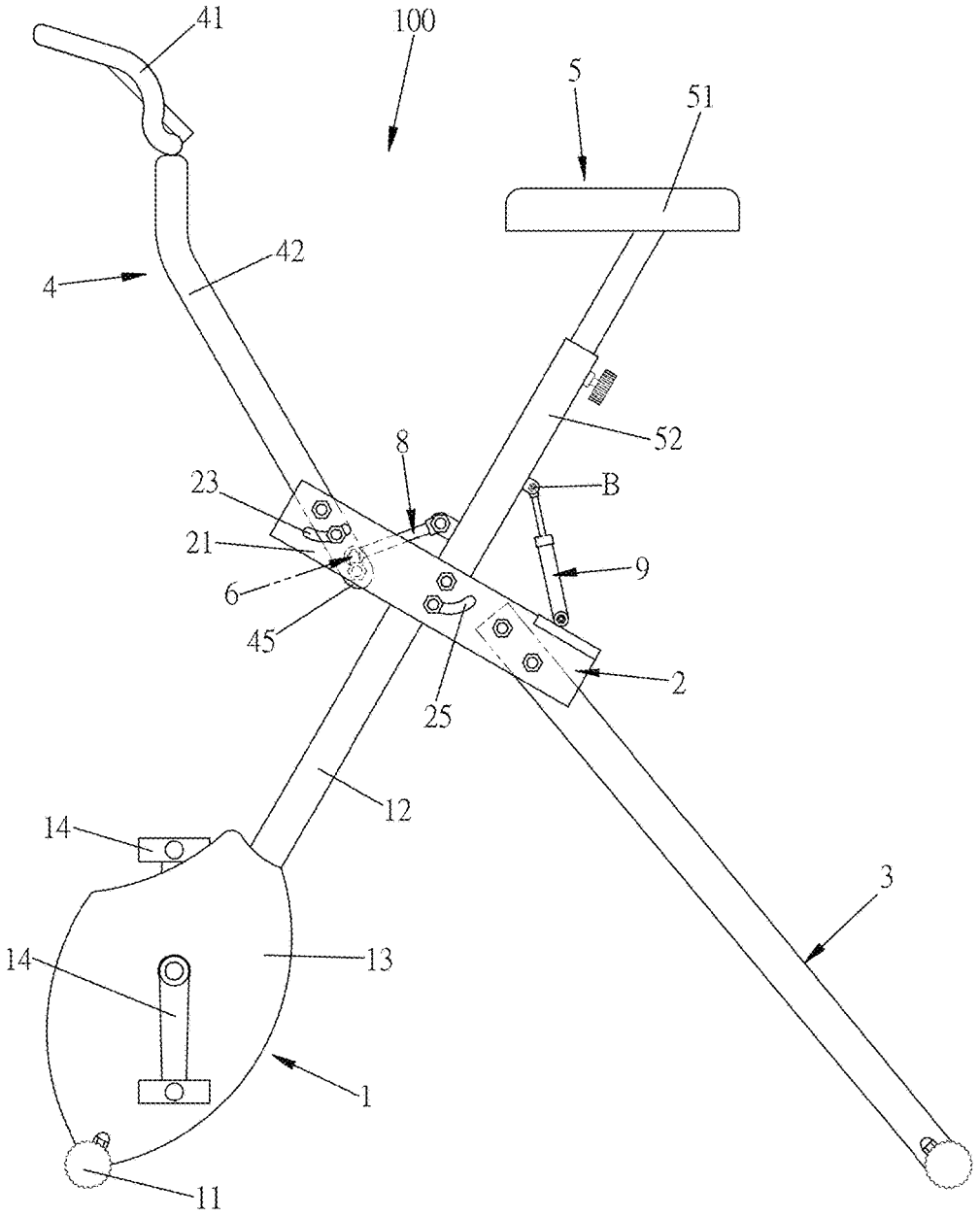
FIG. 6 is a side view of a horse riding exercise machine not having a second N-shaped connecting rod of the present invention.
Figure 7:
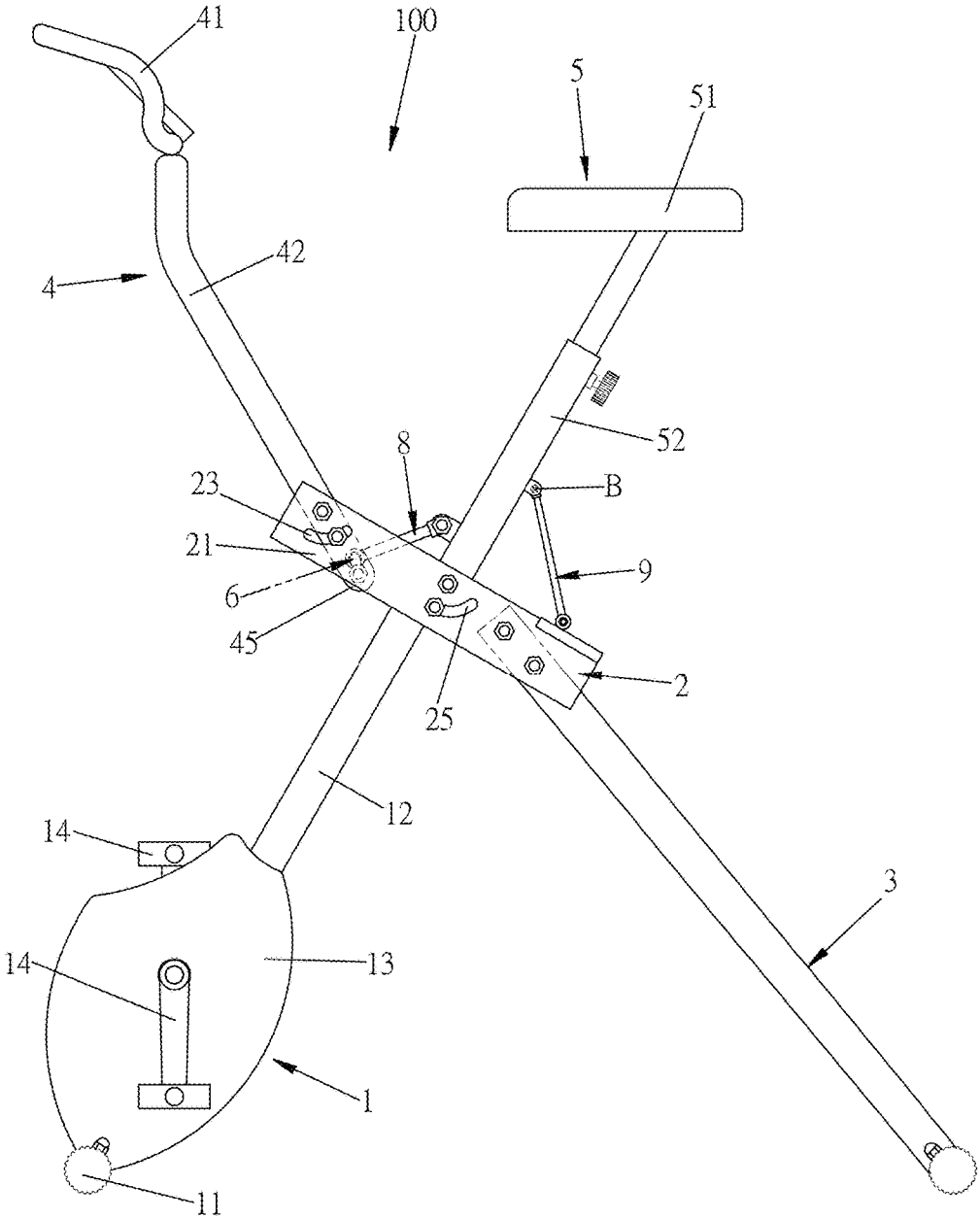
FIG. 7 is a schematic view of FIG. 6, with a return assembly which is a return spring as an illustration.

As shown in FIG. 6 and FIG. 7, the horse riding exercise machine 100 according to an embodiment of the present embodiment comprises a front support base 1, two coupling plates 2, a rear support base 3, a handle support seat 4, a seat support seat 5, and a first N-shaped connecting rod 6.

The front support base 1 has a bottom rod 11, an upright rod 12, a damping device 13, and two pedals 14. The bottom rod 11 is placed in a horizontal manner. The upright rod 12 extends upward obliquely from a predetermined position between two ends of the bottom rod 11, so that the bottom rod 11 and the upright rod 12 jointly form a reverse T-shape. The damping device 13 is disposed at a lower end of the upright rod 12 close to the bottom rod 11. The two pedals 14 are disposed at two sides (left and right sides) of the damping device 13 and connected to an axle of the damping device 13. The two pedals 14 are disposed oppositely and extend in opposite directions (such as, in upper and lower directions) of a radial direction of the damping device 13.

The two coupling plates 2 are disposed at two sides of an upper end of the front support base 1 (the upright rod 12). Each coupling plate 2 has a plate body 21, a first fixing hole 22, a first arc groove 23, a second fixing hole 24, a second arc groove 25, and at least one third fixing hole 26. The plate body 21 is substantially rectangular and disposed at the upper end of the front support base 1 (the upright rod 12). The first fixing hole 22 and the first arc groove 23 are spaced from each other and disposed close to a front end of the plate body 21. The first fixing hole 22 is above the first arc groove 23. The at least one third fixing hole 26 (This embodiment has two third fixing holes as an example, but not limited thereto.) is disposed close to a rear end of the plate body 21. The second fixing hole 24 and the second arc groove 25 are spaced from each other and disposed at a predetermined position between the front end and the rear end of the plate body 21. The second fixing hole 24 is above the second arc groove 25.

A top end of the rear support base 3 is detachably connected to the at least one third fixing hole 26 of each coupling plate 2. For example, through a bolt B, the rear support base 3 is detachably connected to the coupling plates 2, but not limited thereto.

A bottom end of the handle support unit 4 is pivotally connected to a top end of each coupling plate 2. The handle support unit 4 has at least one handle 41, a connecting rod 42, a first shaft hole 43, a first slide hole 44, two extension pieces 45, and two pivot holes 46. The at least one handle 41 (This embodiment has two handles as an example, but not limited thereto.) extends upward from a top end of the connecting rod 42. The two extension pieces 45 extend downward from two sides (left and right sides) of a bottom end of the connecting rod 42, respectively. The two extension pieces 45 are disposed corresponding to the two coupling plates 2, respectively. The two extension pieces 45 are formed with the two pivot holes 46, respectively. The two pivot holes 46 are not coaxial. The first shaft hole 43 and the first slide hole 44 penetrate two sides (i.e., left and right sides) of the connecting rod 42 close to the two extension pieces 45. The first shaft hole 43 is above the first slide hole 44. The first shaft hole 43 corresponds in position to the first fixing hole 22 of each coupling plate 2 to be connected. The first slide hole 44 corresponds in position to the first arc groove 23 of each coupling plate 2 to be connected. The connecting rod 42 is pivoted and slidable along the first arc groove 23 with the first fixing hole 22 as a pivot.

The seat support unit 5 includes a seat 51, a telescopic rod 52, a second shaft hole 53, and a second slide hole 54. The seat 51 is disposed at a top end of the telescopic rod 52. The second shaft hole 53 and the second slide hole 54 are disposed close to a bottom end of the telescopic rod 52. The second shaft hole 53 is above the second slide hole 54. The telescopic rod 52 is inserted between the two coupling plates 2. The second shaft hole 53 corresponds in position to the second fixing hole 24 of each coupling plate 2 to be connected. The second slide hole 54 corresponds in position to the second arc groove 25 of each coupling plate 2 to be connected. The telescopic rod 52 is pivoted and slidable along the second arc groove 25 with the second fixing hole 24 as a pivot.

The first N-shaped connecting rod 6 is disposed between the two extension pieces 45. Two ends of the first N-shaped connecting rod 6 are pivotally connected with the pivot holes 46, respectively. A right rod section 61 of the first N-shaped connecting rod 6 is pivotally connected to a front side of the telescopic rod 52 through a drive rod 8. Preferably, one end of the drive rod 8, connected with the right rod section 61, is a ring. Another end of the drive rod 8, connected with the front side of the telescopic rod 52, has a U shape.

Figure 1:
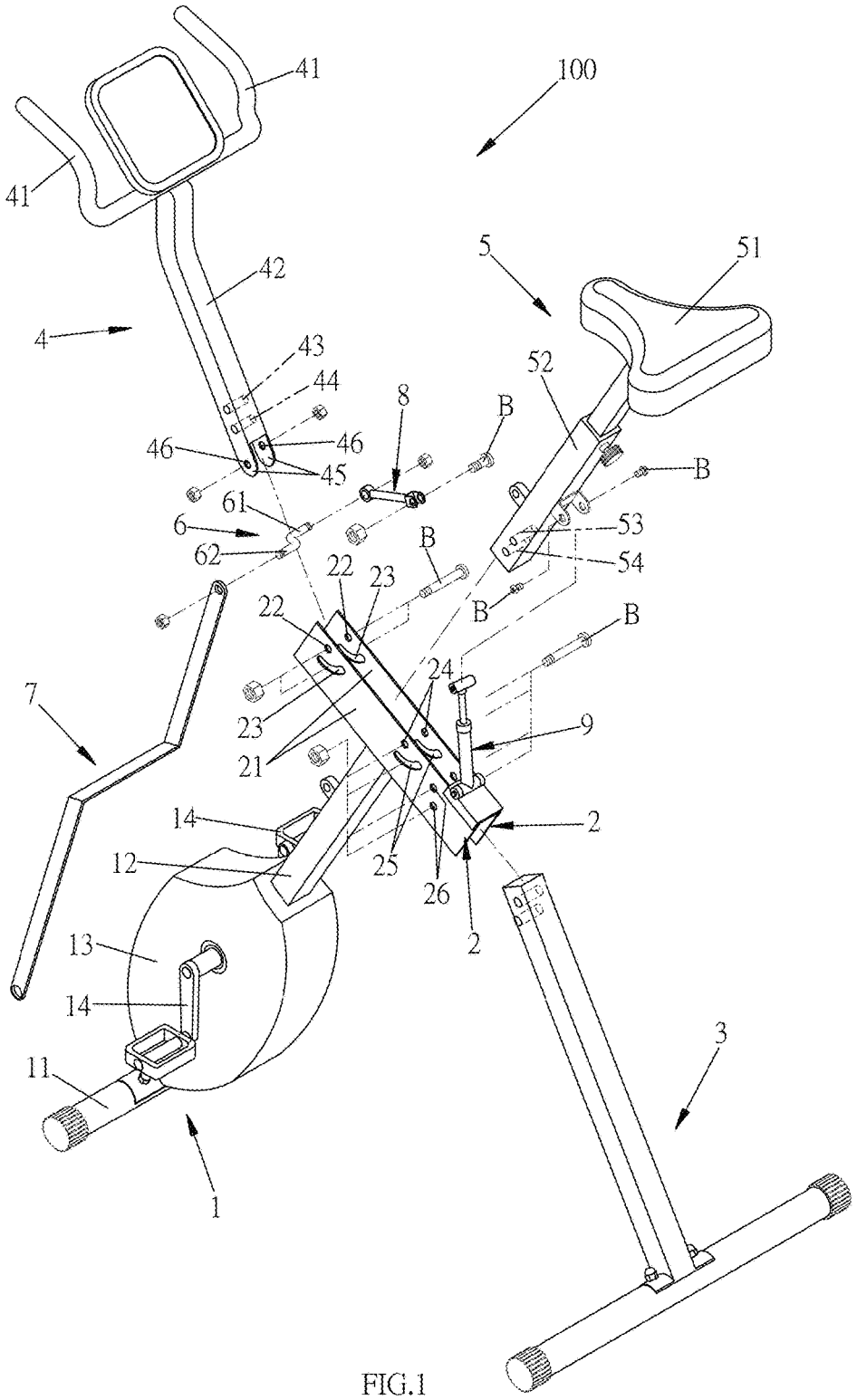
FIG. 1 is an exploded view of a horse riding exercise machine having a second N-shaped connecting rod of the present invention.
Figure 2:
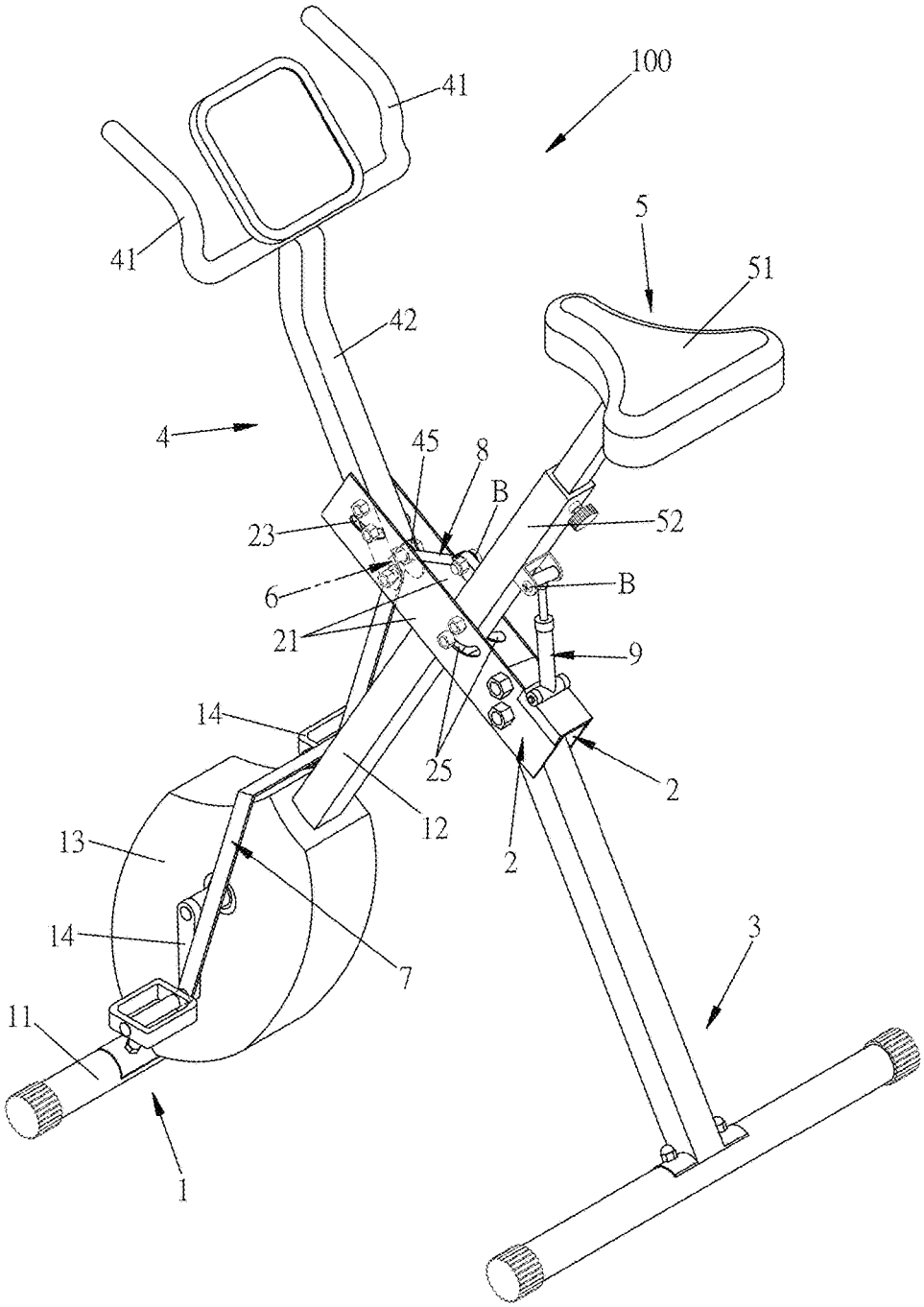
FIG. 2 is a perspective view of FIG. 1.
Figure 3:
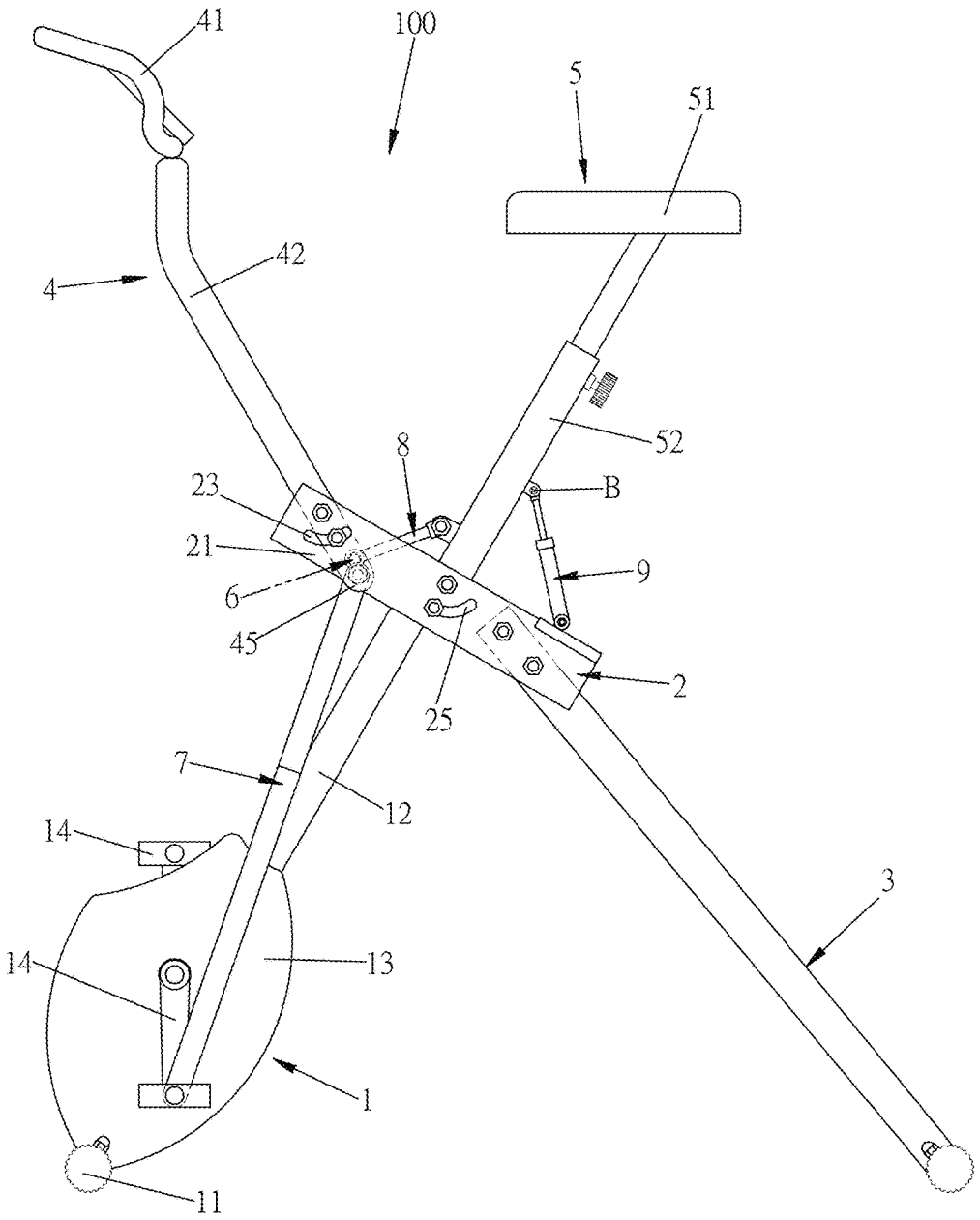
FIG. 3 is a side view of FIG. 1.
Figure 4:
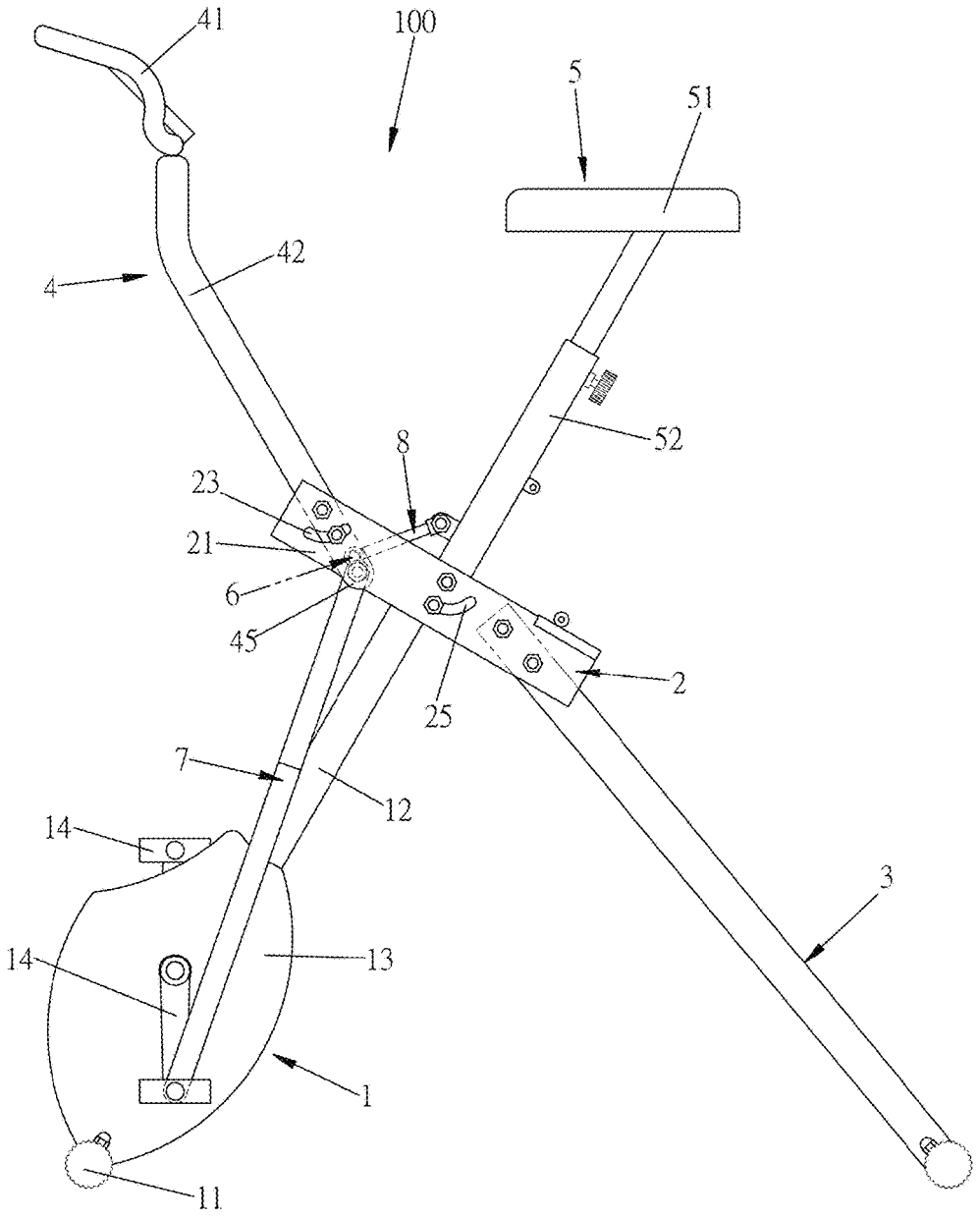
FIG. 4 is a schematic view of FIG. 3, without a return assembly.
Figure 5:
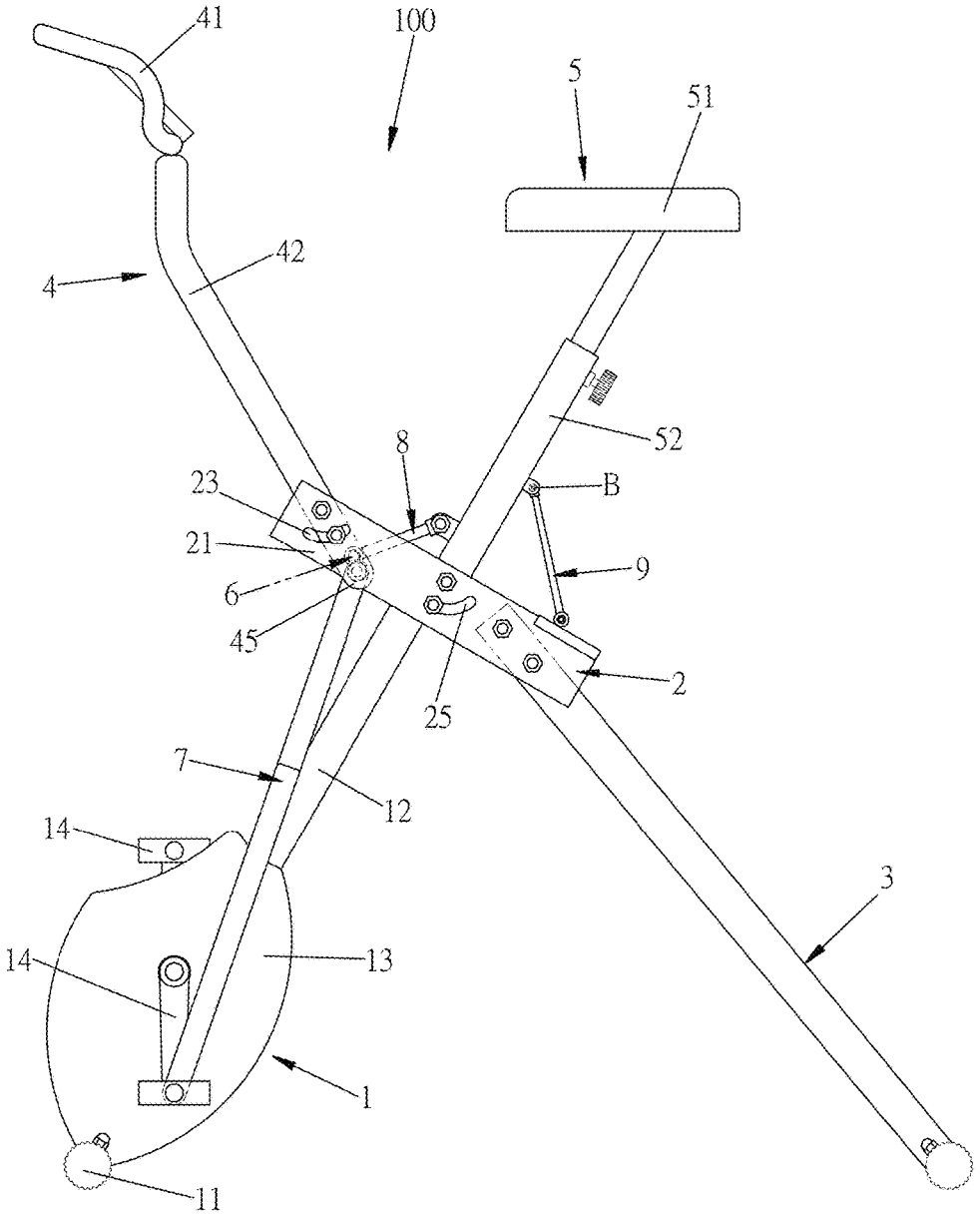
FIG. 5 is a schematic view of FIG. 3, with a return assembly which is a return spring as an illustration.

The horse riding exercise machine 100 according to an embodiment of the present invention, as shown in FIG. 4, doesn't have a return assembly. The horse riding exercise machine of the present invention may further comprise a return assembly 9. Two ends of the return assembly 9 are pivotally connected to a rear end of each coupling plate 2 and a rear side of the telescopic rod 52, respectively. Preferably, the return assembly 9 may be a pneumatic cylinder (as shown in FIG. 6) or a return spring (as shown in FIG. 7).

The horse riding exercise machine 100 according to another embodiment as shown in FIG. 1 to FIG. 5 is substantially similar to the horse riding exercise machine 100 according to the embodiment as shown in FIG. 6 and FIG. 7. The same components are denoted by the same reference numbers, and won't be described repeatedly. The difference is that the horse riding exercise machine 100 of this embodiment further includes a second N-shaped connecting rod 7.

A bottom end of the second N-shaped connecting rod 7 is pivotally connected to the pedal 14 at the left side of the damping device 13, and a top end of the second N-shaped connecting rod 7 is pivotally connected to a left rod section 62 of the first N-shaped connecting rod 6.

When in use, the user can grasp the two handles 41 with both hands and sits on the seat 51 with his/her buttocks, the user's feet are placed on the two pedals 14 for pedaling. When the horse riding exercise machine 100 not having the second N-shaped connecting rod 7 (as shown in FIG. 6 and FIG. 7) is used for doing exercise, the user can pull the handles 41 rearward. That is, the user exerts a force on the handle support unit 4, and then the handle support unit 4 is pivoted toward the seat support unit 5. In detail, the handles 41 are applied with a force to pivot the connecting rod 42, a bolt B passing through the first shaft hole 43 and the first fixing hole 22 functions as a pivot, and the connecting rod 42 is slid and pivoted from the rear end of the first arc groove 23 to the front end of the first arc groove 23 through a bolt B passing through the first slide hole 44 and the first arc groove 23. Meanwhile, the telescopic rod 52 is pivoted toward the handle support unit 4 by the user sitting on the seat 51, a bolt B passing through the second shaft hole 53 and the second fixing hole 24 functions as a pivot, and the telescopic rod 52 is slid and pivoted from the front end of the second arc groove 25 to the rear end of the second arc groove 25 through a bolt B passing through the second slide hole 54 and the second arc groove 25.

After that, the user can exert a force to push the handles 41 forward, and the seat support unit 5 is pushed rearward by the user's buttocks. The pivotal motion is in an opposite direction. Thereby, the handle support unit 4 and the seat support unit 5 are pivoted relative to each other by the user's manual operation (exerting a force) to achieve the effect of a horse riding.

When the horse riding exercise machine 100 having the second N-shaped connecting rod 7 (as shown in FIG. 1 to FIG. 5) is used, the operation is similar to that of the horse riding exercise machine 100 not having the second N-shaped connecting rod 7 (as shown in FIG. 6 and FIG. 7). The difference is described hereinafter. When the pedals 14 of the horse riding exercise machine 100 having the second N-shaped connecting rod 7 are pedaled by the user, the left rod section 62 of the first N-shaped connecting rod 6 is pushed by the top end of the second N-shaped connecting rod 7 to rotate the first N-shaped connecting rod 6, and the right rod section 61 of the first N-shaped connecting rod 6 pushes the handle support unit 4 and the seat support unit 5 to motion relative to each other, achieving a labor-saving effect.

The above-mentioned horse riding exercise machine 100 is provided with the return member 9, so that the handle support unit 4 and the seat support unit 5 can be automatically returned (homed) when the handle support unit 4 and the seat support unit 5 are pivoted relative to each other. This achieves a labor-saving effect for the user to do exercise.

Further, when the user does not use the horse riding exercise machine 100, the user can loosen the bolt B passing through the top end of the rear support base 3 and the at least one third fixing hole 26 of each coupling plate 2 so that the rear support base 3 can be pushed toward the front support base 1 to close up, thereby reducing the storage space to facilitate storage.

According to the aforesaid arrangement and the above description, the horse riding exercise machine 100 of the present invention is not only compact in structure but also easy to be assembled and disassembled. When in use, the second N-shaped connecting rod 7 and/or the return member 9 are configured to provide a labor-saving effect. Through the compact structure and the detachable connection of the bolt B, when the horse riding exercise machine 100 of the present invention is not used, the bolt B passing through the top end of the rear support base 3 and the at least one third fixing hole 26 of each coupling plate 2 can be loosened so that the rear support base 3 can be pushed toward the front support base 1 to close up, thereby reducing the storage space to facilitate the storage.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A horse riding exercise machine, comprising:

a front support base;

two coupling plates, disposed at two sides of an upper end of the front support base, the coupling plates each having a plate body, a first fixing hole, a first arc groove, a second fixing hole, a second arc groove, and at least one third fixing hole, the plate body being disposed at the upper end of the front support base, the first fixing hole and the first arc groove being spaced from each other and disposed close to a front end of the plate body, the first fixing hole being above the first arc groove, the at least one third fixing hole being disposed close to a rear end of the plate body, the second fixing hole and the second arc groove being spaced from each other and disposed at a predetermined position between the front end and the rear end of the plate body, the second fixing hole being above the second arc groove;

a rear support base, a top end of the rear support base being detachably connected to the at least one third fixing hole of each coupling plate;

a handle support unit, a bottom end of the handle support unit being pivotally connected to a top end of each coupling plate, the handle support unit having at least one handle, a connecting rod, a first shaft hole, a first slide hole, two extension pieces, and two pivot holes, the at least one handle extending upward from a top end of the connecting rod, the two extension pieces extending downward from two sides of a bottom end of the connecting rod respectively, the two extension pieces being disposed corresponding to the two coupling plates respectively, the two extension pieces being formed with the two pivot holes respectively, the two pivot holes being not coaxial, the first shaft hole and the first slide hole penetrating two sides of the connecting rod close to the two extension pieces, the first shaft hole being above the first slide hole, the first shaft hole corresponding in position to the first fixing hole of each coupling plate to be connected, the first slide hole corresponding in position to the first arc groove of each coupling plate to be connected, the connecting rod being pivoted and slidable along the first arc groove with the first fixing hole as a pivot;

a seat support unit, including a seat, a telescopic rod, a second shaft hole, and a second slide hole, the seat being disposed at a top end of the telescopic rod, the second shaft hole and the second slide hole being disposed close to a bottom end of the telescopic rod, the second shaft hole being above the second slide hole, the telescopic rod being inserted between the two coupling plates, the second shaft hole corresponding in position to the second fixing hole of each coupling plate to be connected, the second slide hole corresponding in position to the second arc groove of each coupling plate to be connected, the telescopic rod being pivoted and slidable along the second arc groove with the second fixing hole as a pivot; and a first N-shaped connecting rod, disposed between the two extension pieces, two ends of the first N-shaped connecting rod being pivotally connected to the pivot holes respectively, a right rod section of the first N-shaped connecting rod being pivotally connected to a front side of the telescopic rod through a drive rod.

2. The horse riding exercise machine as claimed in claim 1, further comprising a return assembly, two ends of the return assembly being pivotally connected to a rear end of each coupling plate and a rear side of the telescopic rod, respectively.

3. The horse riding exercise machine as claimed in claim 2, wherein the return assembly is one of a pneumatic cylinder and a return spring.

4. The horse riding exercise machine as claimed in claim 1, wherein one end of the drive rod, connected with the right rod section, is a ring, and another end of the drive rod, connected with the front side of the telescopic rod, has a U shape.

5. The horse riding exercise machine as claimed in claim 1, wherein the front support base has a bottom rod, an upright rod, a damping device, and two pedals, the bottom rod is placed in a horizontal manner, the upright rod extends upward obliquely from a predetermined position between two ends of the bottom rod, the damping device is disposed at a lower end of the upright rod close to the bottom rod, the two pedals are disposed at two sides of the damping device and connected to an axle of the damping device, and the two pedals are disposed oppositely and extend in opposite directions of a radial direction of the damping device.

6. A horse riding exercise machine, comprising:

a front support base, the front support base having a bottom rod, an upright rod, a damping device, and two pedals, the bottom rod being placed in a horizontal manner, the upright rod extending upward obliquely from a predetermined position between two ends of the bottom rod, the damping device being disposed at a lower end of the upright rod close to the bottom rod, the two pedals being disposed at two sides of the damping device and connected to an axle of the damping device, the two pedals being disposed oppositely and extending in opposite directions of a radial direction of the damping device;

two coupling plates, disposed at two sides of an upper end of the front support base, the coupling plates each having a plate body, a first fixing hole, a first arc groove, a second fixing hole, a second arc groove, and at least one third fixing hole, the plate body being disposed at the upper end of the front support base, the first fixing hole and the first arc groove being spaced from each other and disposed close to a front end of the plate body, the first fixing hole being above the first arc groove, the at least one third fixing hole being disposed close to a rear end of the plate body, the second fixing hole and the second arc groove being spaced from each other and disposed at a predetermined position between the front end and the rear end of the plate body, the second fixing hole being above the second arc groove;

a rear support base, a top end of the rear support base being detachably connected to the at least one third fixing hole of each coupling plate;

a handle support unit, a bottom end of the handle support unit being pivotally connected to a top end of each coupling plate, the handle support unit having at least one handle, a connecting rod, a first shaft hole, a first slide hole, two extension pieces, and two pivot holes, the at least one handle extending upward from a top end of the connecting rod, the two extension pieces extending downward from two sides of a bottom end of the connecting rod respectively, the two extension pieces being disposed corresponding to the two coupling plates respectively, the two extension pieces being formed with the two pivot holes respectively, the two pivot holes being not coaxial, the first shaft hole and the first slide hole penetrating two sides of the connecting rod close to the two extension pieces, the first shaft hole being above the first slide hole, the first shaft hole corresponding in position to the first fixing hole of each coupling plate to be connected, the first slide hole corresponding in position to the first arc groove of each coupling plate to be connected, the connecting rod being pivoted and slidable along the first arc groove with the first fixing hole as a pivot;

a seat support unit, including a seat, a telescopic rod, a second shaft hole, and a second slide hole, the seat being disposed at a top end of the telescopic rod, the second shaft hole and the second slide hole being disposed close to a bottom end of the telescopic rod, the second shaft hole being above the second slide hole, the telescopic rod being inserted between the two coupling plates, the second shaft hole corresponding in position to the second fixing hole of each coupling plate to be connected, the second slide hole corresponding in position to the second arc groove of each coupling plate to be connected, the telescopic rod being pivoted and slidable along the second arc groove with the second fixing hole as a pivot;

a first N-shaped connecting rod, disposed between the two extension pieces, two ends of the first N-shaped connecting rod being pivotally connected to the pivot holes respectively, a right rod section of the first N-shaped connecting rod being pivotally connected to a front side of the telescopic rod through a drive rod; and a second N-shaped connecting rod, a bottom end of the second N-shaped connecting rod being pivotally connected to the pedal at the left side of the damping device, a top end of the second N-shaped connecting rod being pivotally connected to a left rod section of the first N-shaped connecting rod.

7. The horse riding exercise machine as claimed in claim 6, further comprising a return assembly, two ends of the return assembly being pivotally connected to a rear end of each coupling plate and a rear side of the telescopic rod, respectively.

8. The horse riding exercise machine as claimed in claim 7, wherein the return assembly is one of a pneumatic cylinder and a return spring.

9. The horse riding exercise machine as claimed in claim 6, wherein one end of the drive rod, connected with the right rod section, is a ring, and another end of the drive rod, connected with the front side of the telescopic rod, has a U shape.

* * * * *